US011174748B2

(12) United States Patent
Le Biez et al.

(10) Patent No.: US 11,174,748 B2
(45) Date of Patent: Nov. 16, 2021

(54) RING-SHAPED THERMOMECHANICAL PART FOR TURBINE ENGINE

(71) Applicant: SAFRAN AIRCRAFT ENGINES, Paris (FR)

(72) Inventors: Philippe Charles Alain Le Biez, Draveil (FR); Serge Georges Vladimir Selezneff, Maisons-Alfort (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 967 days.

(21) Appl. No.: 15/247,184

(22) Filed: Aug. 25, 2016

(65) Prior Publication Data

US 2017/0058688 A1 Mar. 2, 2017

(30) Foreign Application Priority Data

Aug. 25, 2015 (FR) ..... 1557916

(51) Int. Cl.

| | |
|---|---|
| ***F01D 11/12*** | (2006.01) |
| ***F04D 29/52*** | (2006.01) |
| ***F01D 25/00*** | (2006.01) |
| ***F04D 29/02*** | (2006.01) |
| ***F01D 5/02*** | (2006.01) |
| ***F01D 25/24*** | (2006.01) |

(52) U.S. Cl.

CPC ..... *F01D 11/122* (2013.01); *F01D 5/02* (2013.01); *F01D 25/005* (2013.01); *F01D 25/24* (2013.01); *F04D 29/023* (2013.01); *F04D 29/526* (2013.01); *F05D 2220/30* (2013.01); *F05D 2300/224* (2013.01); *F05D 2300/437* (2013.01); *F05D 2300/502* (2013.01); *F05D 2300/603* (2013.01); *F05D 2300/611* (2013.01)

(58) Field of Classification Search

None

See application file for complete search history.

(56) References Cited

U.S. PATENT DOCUMENTS

| | | | | |
|---|---|---|---|---|
| 4,068,027 | A * | 1/1978 | Van Ornum | |
| 4,714,734 | A * | 12/1987 | Hashimoto | |
| 4,938,820 | A * | 7/1990 | McMills | |
| 6,334,617 | B1 | 1/2002 | Putnam et al. | |
| 7,098,275 | B2 * | 8/2006 | Inglefield | B22C 9/00 264/125 |
| 8,020,875 | B2 * | 9/2011 | Putnam | F01D 11/122 277/415 |
| 8,034,153 | B2 * | 10/2011 | Marchiando | C22C 29/16 75/244 |
| 2001/0025066 | A1 | 9/2001 | Meguriya | |

(Continued)

FOREIGN PATENT DOCUMENTS

FR 2 887 890 A1 1/2007

OTHER PUBLICATIONS

French Search Report dated Jul. 6, 2016, in corresponding French Patent Application No. 1557916 (2 pages).

*Primary Examiner* — Kayla Mccaffrey

(74) *Attorney, Agent, or Firm* — Bookoff McAndrews, PLLC

(57) ABSTRACT

A ring-shaped thermomechanical part for a turbine engine, comprising at least one coating including a polymeric matrix and fillers in non-deflagrating carbon exclusively comprising the chemical element C. A turbine engine comprising such a part.

12 Claims, 2 Drawing Sheets

(56) References Cited

U.S. PATENT DOCUMENTS

| | | | | |
|---|---|---|---|---|
| 2010/0279104 | A1 | 11/2010 | Putnam et al. | |
| 2011/0204281 | A1* | 8/2011 | Rouse | B82Y 30/00 252/75 |
| 2015/0322809 | A1* | 11/2015 | Strock | B82Y 30/00 415/173.4 |
| 2016/0208367 | A1* | 7/2016 | Miller | B22D 25/06 |

* cited by examiner

RING-SHAPED THERMOMECHANICAL PART FOR TURBINE ENGINE

CROSS-REFERENCE TO RELATED APPLICATION(S)

This patent application claims the benefit under 35 U.S.C. § 119 to French Patent Application No. 1557916, filed on Aug. 25, 2015, the entirety of which is incorporated herein by reference.

FIELD OF THE INVENTION

The present discussion relates to a ring-shaped thermomechanical part for a turbine engine, which may for example be used as an abradable part or a sealing part. The present discussion also relates to a turbine engine stage and to a turbine engine comprising such a thermomechanical part.

TECHNOLOGICAL BACKGROUND

In turbine engines, for example of aircraft engines, certain portions of the rotor may come into contact with the stator in certain operating configurations. In order to avoid their destruction in these situations, the stators are generally equipped with coatings allowing the interface and which are designated as <<abradables>>.

Figure 1:
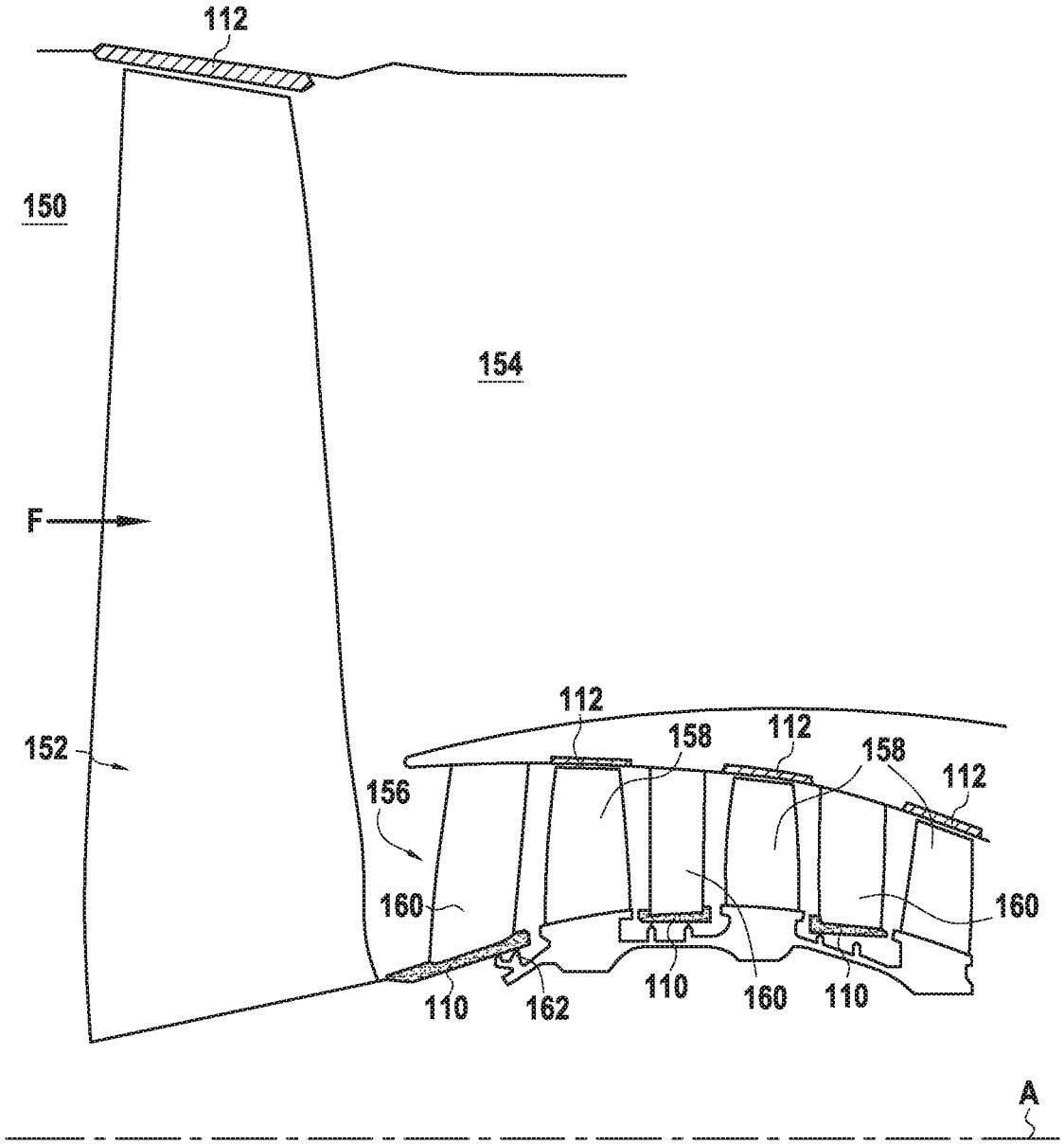
FIG.1 PRIOR ART

FIG. 1 schematically illustrates a portion of a turbine engine 150 of the state of the art. In this example, the turbine engine 150 is a dual flow turbine engine. In this case, an air flow F is stirred by blades 152 of a fan and penetrates into the turbine engine 150, wherein it is then divided and distributed between a flow path 154 and a compressor 156. The compressor 156 comprises moving blades 58 and stator vanes, or fixed vanes, 160.

As illustrated in FIG. 1, sealing materials 110 are provided at the root of the stator vanes 160. These materials are generally formed with a resin loaded with hollow aluminosilicate glass beads. In so far that these materials 110 are in contact with sealing wipers 162 of the rotor, they undergo slight abrasion. The debris resulting from this abrasion are removed without passing through the hot portions of the turbine engine.

Moreover, abradable materials 112 are provided on the stator portions, facing the moving blades 152, 158. For these abradable materials 112, the abraded volumes are greater and the abrasion debris follow the air flow towards the combustion chamber. Now, the temperature of the air flow gradually increasing towards the combustion chamber, the resins loaded with aluminosilicate glass beads then degrade while the beads melt, thereby adhering onto the internal walls of ventilation holes of the blades and of the turbine distributors, which promotes adhesion of the particles contained in the resin and deteriorates the cooling of the turbine engine. Even in the case when they do not melt, the aluminosilicate beads soften sufficiently in order to reform, after abrasion, aggregates which may clog the cooling channels of the turbine engine.

Further, as an abradable material, a second material consisting of an aluminum alloy and of an organic structuring agent of the polyester type obtained by thermal projection is also known. The use of this material will be limited in the future because of the increase of the temperatures and of the pressure in the high pressure compressor and in the combustion chambers. Indeed, the aluminum which makes it up is sensitive to self-inflammation phenomena and therefore deflagration phenomena.

The invention aims at least at finding a partial remedy to these drawbacks.

PRESENTATION OF THE INVENTION

For this purpose, the present discussion relates to a ring-shaped thermomechanical part for a turbine engine, comprising at least one coating including a polymeric matrix and fillers in non-deflagrating carbon.

In the sense of the present discussion, a non-deflagrating (explosion proof) material is a material which does not have any spontaneous inflammation in connection with a grain size, a pressure and a temperature. More particularly, in the sense of the present discussion, a non-deflagrating material is a material which, regardless of its shape and of its size, does not exhibit spontaneous inflammation under the temperature and pressure conditions encountered in a turbine engine, for example temperatures ranging up to about 1,500° C. and pressures ranging up to about 30 bars.

In the present discussion, a compound called carbon exclusively comprises the chemical element C.

Among the carbons usually used in industry, the non-deflagrating carbon may be: crystalline carbon black, amorphous carbon black, furnace black, thermal black, tunnel black, smoke black, acetylene black, hard carbon (non-graphitizable carbon). On the other hand, natural graphite, which is rather used for lubrication purposes, is not suitable because it contains trace amounts of oils and may burn. Also, Ketjen black is not considered as non-deflagrating carbon; actually it comprises not only carbon but also graphite and a binder. Also, soot is not suitable for the present invention.

Carbon has several advantages. It does not melt and therefore does not adhere to the ventilation holes, which are not blocked. Further, carbon is non-deflagrating and does not generate any explosion in the turbine engine. Moreover, the coating including a polymeric matrix and non-deflagrating carbon fillers is both adapted for the use as an abradable material, facing the moving blades, and to the use as a sealing material, at the root of the stator vanes. The architecture and the manufacturing of the turbine engine are therefore simplified, since it is now possible to only use one single type of coating.

Further, the matrix is in polymer. Thus, as opposed to other materials, for example consisting of a metal portion and of an organic portion and subject to explosion and self-inflammation phenomena which may damage the turbine engine, the present thermomechanical part is suitable for turbine engines in which the temperature and/or the pressure are increased with a view to improving the performances.

In certain embodiments, the carbon does not ignite in a Hartmann tube. The Hartmann tube is an explosivity test means known to one skilled in the art.

In certain embodiments, the carbon has a self-inflammation temperature above 1,900° C. This temperature is meant at atmospheric pressure, in a highly oxygen-rich medium, for example comprising dioxygen in large proportions (for example more than 25% molar) and dinitrogen. Carbon alone does not burn, it becomes red-hot under the effect of the temperature and may decompose into finer particles. Thus, the carbon transformation temperature is much higher than the temperatures encountered in turbine engine compressors, of the order of 450° C. to 500° C., and at the temperatures encountered in the combustion chamber, of the order of 1,300° C. to 1,500° C. This guarantees that the carbon debris will not undergo any physico-chemical transformations which may damage the turbine engine.

In certain embodiments, the fillers are in the form of round particles, of acicular particles, of fibers, of mat, of fabric or of foam. The fillers may be in the form of non-woven material. The fibers may be short fibers, with a maximum size comprised between 5 mm and 10 mm, or longer fibers.

In certain embodiments, the mass level of fillers in the matrix is comprised between 5% and 90%, and may preferably have the value of about 50%. As this will be specified subsequently, the mass level of fillers depends on the nature of the filler used. A low level, for example less than or equal to 50%, allows the thermomechanical part to retain good elasticity; such a level is particularly suitable for a use of the thermomechanical part as a sealing material. A higher level, for example greater than or equal to 50%, increases the abradable nature of the thermomechanical part.

In certain embodiments, the polymeric matrix mainly comprises at least one polysiloxane. It is understood that said at least one polysiloxane forms the main component of the matrix, for example at least 50% of the matrix, preferentially at least 60% of the matrix, more preferentially at least 70% of the matrix, more preferentially at least 80% of the matrix, more preferentially at least 90% of the matrix, more preferentially at least 95% of the matrix. The polysiloxane may be a silicone resin.

The present discussion also relates to a turbine engine stage comprising a casing and a rotor configured for rotating inside the casing, the stage further comprising a thermomechanical part as described earlier, placed on the casing and radially located between the rotor and the casing. The radial direction is meant with respect to the axis of rotation of the rotor. In such a turbine engine stage, the thermomechanical part is used as an abradable material.

The present discussion also relates to a turbine engine stage comprising a casing and a stator part mounted in the casing, the stage further comprising a thermomechanical part as described earlier, placed on the casing and joining the casing and the stator part. In such a turbine engine stage, the thermomechanical part is used as a sealing material for connecting the stator part to the casing while preventing transmission of vibrations.

The present discussion also relates to a turbine engine comprising a thermomechanical part as described earlier, and/or a turbine engine stage as described earlier.

SHORT DESCRIPTION OF THE DRAWINGS

Figure 2:
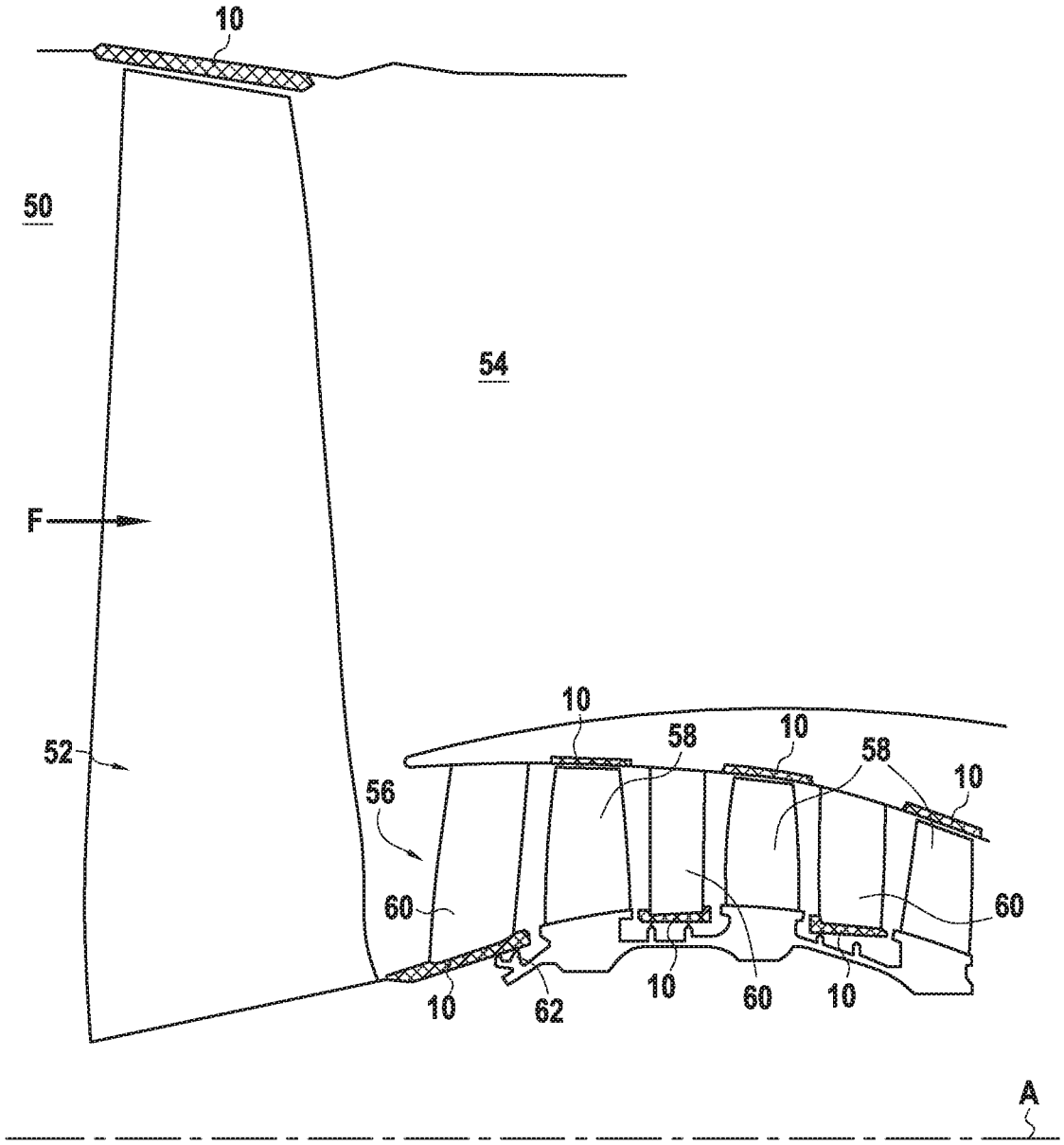

The inventions and advantages thereof will be better understood upon reading the detailed description which follows, of embodiments of the invention given as non-limiting examples. This description makes reference to the appended drawings, wherein:

FIG. 1, already described, is a partial sectional view of a turbine engine of the state of the art, comprising abradable coatings and sealing materials;

FIG. 2 is a partial sectional view of a turbine engine comprising thermomechanical parts according to an embodiment of the invention.

DETAILED DESCRIPTION OF THE INVENTION

FIG. 2 is a view similar to that of FIG. 1 already described. The elements corresponding to or identical with those of the state of the art will receive the same reference symbol, to within the figure of hundreds, and will not be described again.

The turbine engine 50 illustrated in FIG. 2 comprises a plurality of thermomechanical parts 10, used equally as an abradable material or as a sealing material. The thermomechanical parts 10 are ring shaped in this example.

As indicated earlier, the thermomechanical parts 10 comprise at least one coating including a polymeric matrix and non-deflagrating carbon fillers.

In this embodiment, the polymeric matrix mainly comprises at least one polysiloxane, more particularly here a silicone resin, preferably a bulk cross-linking two-component silicone resin at room temperature and at a temperature.

Moreover, the fillers here are in the form of carbon fibers and more particularly of short fibers, i.e. of a larger size comprised between about 5 mm and 10 mm. In this embodiment, the mass level of fillers in the matrix has the value of about 70%. As indicated earlier, a mass level of fillers of about 50% or more is favorable for the use of the thermomechanical part as an abradable material.

The higher the mass level of fillers in non-deflagrating carbon, the less the abraded material circulating in the turbine engine will be able to undergo self-inflammation.

When the thermomechanical part 10 is intended to be used exclusively as an abradable material, the fillers will preferentially be in the form of a powder of an indifferent form. Conversely, when the thermomechanical part 10 is intended to be used as an abradable part or as a sealing material, the use of fillers as fibers, particularly as long fibers, improves the mechanical strength of the coating.

After abrasion of the thermomechanical parts 10 by the moving blades 50 or to a lesser extent by the wipers 62, the material removed by abrasion (matrix and fillers) is removed as dust. More specifically, the material removed by the fan blades 52 is discharged into the flow path 54. The material removed by the compressor blades 58 is discharged towards the combustion chamber. The material removed by the wipers 62 is discharged by the air flow and directed towards the counter-pressure chambers. Further, as the fillers are in non-deflagrating carbon, this dust does not soften, does not adhere to the walls of the turbine engine, does not ignite and does not generate aggregates which may clog the ventilation channels of the turbine engine.

A test for self-inflammation of carbon in a Hartmann tube will now be described. In a Hartmann tube, an electric spark is generated between two electrodes within a cloud of carbon dusts lifted by an air jet and it is noted whether an inflammation occurs or not. In the apparatus used, the maximum energy which may be used for the spark is 1,200 megajoules (MJ).

The minimum inflammation energy (MIE) of the carbon, here as a dust, is measured. The MIE of a dust is defined by the international standard IEC 1241-2-3 as being comprised between the strongest energy E1 at which inflammation does not occur during at least 20 successive tests for attempting to inflame a dust/air mixture and the lowest energy E2 at which inflammation occurs during 20 successive tests. The energy is, in the present case, provided by an electric spark.

In this case, it is seen that during 20 successive tests with a spark of 1,200 MJ, the carbon does not ignite. Therefore, the carbon has a minimum inflammation energy (MIE) strictly greater than 1,200 megajoules (MJ).

A method for coating a ring-shaped thermomechanical part for a turbine engine will now be described. Such a method may comprise the following steps:

providing a polymeric matrix;

loading the matrix with non-deflagrating carbon fillers;

applying the loaded matrix on the part.

The application step results in that the part comprises at least one coating including a polymeric matrix and fillers in non-deflagrating carbon.

It is preferable that the coating method be applied under a protected atmosphere, so as not to contaminate the non-deflagrating carbon used for loading the matrix.

The step of loading the matrix with said fillers may comprise mixing the loaded matrix, for example by means of a static or dynamic mixer, in order to ensure homogeneity thereof. Moreover, the step of loading the matrix may comprise extracting the air bubbles from the loaded matrix. If applicable, this extraction of bubbles is preferably provided after the mixing with mixer.

The step of loading the matrix with non-deflagrating carbon fillers may be carried out manually, by injection, with the method known to one skilled in the art as <<Resin Transfer Molding>> (RTM), or by infusion. The manual application, the injection and the RTM method may be used for directly applying the coating of a loaded matrix onto the part. Infusion may be used for impregnating with a polymeric matrix a preform in non-deflagrating carbon (notably fibers or a fabric), which preform should then be added onto the part, for example by adhesive bonding.

The embodiment described with reference to FIG. 2 is such that the entire part is formed with the single coating. In other embodiments, the thermomechanical part may comprise a support on which the coating is applied.

The embodiment described with reference to FIG. 2 is such that the same coating is used as an abradable material and as a sealing material. However, depending on the different uses, it is possible to provide different coatings, for example coatings having different mass filler levels and/or different filler shapes.

Although the present invention has been described with reference to specific exemplary embodiments, modifications may be provided to these examples without departing from the general scope of the invention as defined by the claims. In particular, individual features of the different illustrated/mentioned embodiments may be combined in additional embodiments. Therefore, the description and the drawings have to be considered in an illustrative sense rather than a restrictive sense.

The invention claimed is:

1. A turbine engine comprising a ring-shaped thermomechanical part for a turbine engine, the ring-shaped thermomechanical part comprising at least one coating including a polymeric matrix and fillers, wherein the fillers are exclusively non-deflagrating carbon fillers comprising the chemical element C, and wherein the fillers are in the form of round particles, acicular particles, fibers, mat, fabric, or foam.

2. The turbine engine according to claim 1, wherein the carbon has a self-inflammation temperature above 1,900° C.

3. The turbine engine according to claim 1, wherein the fillers are in carbon black.

4. The turbine engine according to claim 1, wherein the polymeric matrix mainly comprises a polysiloxane.

5. The turbine engine according to claim 1, wherein a mass content of the fillers in the thermomechanical part is at least 50%.

6. The turbine engine according to claim 1, wherein the fillers are in the form of round particles, acicular particles, mat, fabric, or foam.

7. A turbine engine stage comprising a casing and a rotor configured so as to rotate inside the casing, the stage further comprising a thermomechanical part placed on the casing and radially located between the rotor and the casing, wherein the thermomechanical part comprises at least one coating including a polymeric matrix and fillers, wherein the fillers are exclusively non-deflagrating carbon fillers comprising the chemical element C, and wherein the fillers are in the form of round particles, acicular particles, fibers, mat, fabric or foam.

8. A turbine engine comprising a turbine engine stage according to claim 7.

9. A turbine engine stage comprising a casing and a stator part mounted in the casing, the stage further comprising a thermomechanical part comprising at least one coating including a polymeric matrix and non-deflagrating carbon fillers exclusively comprising the chemical element C, wherein the thermomechanical part is placed on the casing and used as a sealing material for joining the casing and the stator part.

10. The turbine engine stage according to claim 9, wherein a mass content of the fillers in the thermomechanical part is less than or equal to 50%.

11. The turbine engine stage according to claim 9, wherein a mass content of the fillers in the thermomechanical part is at least 50%.

12. The turbine engine according to claim 9, wherein the fillers are in the form of round particles, acicular particles, mat, fabric, or foam.

* * * * *